United States Patent [19]

Miyahara et al.

[11] 4,386,904

[45] Jun. 7, 1983

[54] COLORED FLAME CANDLE

[75] Inventors: Hisao Miyahara; Tatsumi Tsukamura, both of Okayama, Japan

[73] Assignee: Pegasus Candle Co., Ltd., Okayama, Japan

[21] Appl. No.: 216,857

[22] Filed: Dec. 16, 1980

[51] Int. Cl.[3] ..... F23Q 2/32

[52] U.S. Cl. ..... 431/126; 431/288; 44/7.5

[58] Field of Search ..... 431/288, 126, 4; 44/7.5; 264/271.1

[56] References Cited

U.S. PATENT DOCUMENTS

| | | | |
|---|---|---|---|
| 15,821 | 9/1856 | Sanders | 431/288 |
| 984,029 | 2/1911 | Scheuble | 44/7.5 X |
| 3,150,510 | 9/1964 | Klopfenstein | 44/7.5 X |
| 3,194,031 | 7/1965 | Gorman, Jr. | 44/7.5 X |
| 3,266,272 | 8/1966 | Fredericks | 44/7.5 |
| 3,582,251 | 6/1971 | Concannon | 431/288 X |
| 3,615,289 | 10/1971 | Felton | 44/7.5 |
| 3,844,706 | 10/1974 | Tsaras | 431/288 |
| 3,925,029 | 12/1975 | Wilson | 44/7.5 |

*Primary Examiner*—Larry Jones

*Attorney, Agent, or Firm*—Koda and Androlia

[57] ABSTRACT

In order to produce vividly colored flames, instead of conventional primary combustion agents, such as paraffin and stearic acid, which produce a yellowish orange color by themselves, the primary combustion materials are used which form a colorless flame such as ethyl carbamate (urethane), dimethyl oxalate, and/or trioxane; in addition, an oxidation accelerator catalyst is absorbed on the cotton combustion wick, to result in a candle that itself burns with a strictly colorless flame. A coloring wick is separately fabricated containing a color-forming compound as well as oxidation accelerating catalyst and preferably may be coated with resin on its surface. The coloring wick is then placed adjacent the combustion wick, and a candle is formed using the aforementioned primary combustion material. One or several coloring wicks may be embedded parallel to the combustion wick or may be embedded coiled around the combustion wick.

9 Claims, 6 Drawing Figures

COLORED FLAME CANDLE

BACKGROUND OF THE INVENTION

1. Field of the Invention

The present invention generally pertains to candles that burn with a flame having a characteristic color, and in particular to candles that burn with a vividly colored flame such as red, blue, purple, yellow, white, etc.

2. Prior Art

Recently, the commercial significance of candles has shifted from a basically utilitarian product that merely provides illumination to a product whose function is to create a desired atmosphere by means of light and color. To that end, there have been many attempts at providing candles which burn with various types of colored flames. Most of such conventional prior art colored flame candles use metallic salts as coloring agents, either by compounding said coloring agents with the primary combustion material of the candle or else by incorporating them into the candle's combustion wick by means of absorption or the use of binders. Although fairly marked improvements have been made in such prior art candles, up to present time, attempts to obtain the large, vividly colored flame required for many desired effects have failed, since it has not been possible to eliminate the yellowish orange flame such as is associated with primary combustion materials such a paraffin, stearic acid, or of the wick itself.

Until now in attempt to inhibit the yellowish orange color associated with the combustion of paraffin, carbamic acid or oxalate has been used instead of paraffin as a primary combustion agent (see for instance U.S. Pat. No. 2,481,019) but with such alternative material, when the candle diameter is less than 10 mm, sufficient caking ability necessary to retain the candle shape is lacking and a high setting strength is unobtainable. In order to overcome this, stearic acid, etc. may be added about (about 15–50%) for improving the candle shape retaining properties but this causes much of the flame's end to assume the undesirable yellowish orange color during burning, and even when primary combustion materials which burn with a colorless flame, such as ethyl carbamate, are used, a completely colorless combustion flame cannot be obtained and the desired vividly colored flame remained unobtainable.

Thus there remained a need in the prior art for a candle which burned with a vividly colored flame which was strong and free of any yellowish orange color.

BRIEF SUMMARY OF THE INVENTION

Briefly, in accordance with different aspects of the present invention, a colored flame candle may be provided by (1) absorbing an oxidation accelerating catalyst into the candle combustion wick for preventing the yellowish orange color that would otherwise result from the burning of the wick and for thereby improving the coloration of the candle flame; (2) mixing compatible synthetic resins with a primary combustion material having a colorless flame such ethyl carbamate to improve the formability as well as the shape retainability of the primary combustion material; (3) coating a separately prepared coloring wick with a color former containing a flame coloring metallic compound and an oxidation accelerating catalyst in order to chromogenic (color forming) property, and (4) maintaining the separate identities of the combustion wick and the coloring wick when they are embedded in the primary combustion material.

BRIEF DESCRIPTION OF THE DRAWINGS

The above-mentioned features and objects of the present invention will become more apparent with reference to the following description taken in conjunction with the accompanying drawings wherein like reference numerals refer to like elements and in which.

DETAILED DESCRIPTION OF THE INVENTION

Figure 1:
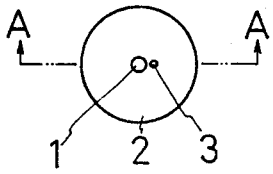
FIG. 1 is a plan view of a preferred embodiment of the colored flame candle.

In the present invention it is important to select the properties of the materials to have certain characteristics. In particular for the combustion wick, it is preferable to use the plaited cotton yarn or twisted cotton yarn of the prior art, but it is important in addition to actively facilitate the combustive oxidation in order to eliminate the yellowish orange flame formed during the buring of the wick thread itself. To that end, it is advisable to use platinum, palladium, or vanadium, or a compound thereof as an oxidation accelerating catalyst for the combustion wick. A mixture of one or more of said metals may be processed to be carried by supporters, such as fine alumina powder, acid clay or silica gel, and said supporters may in turn be adhered to the combustion wick. Alternatively, the combustion wick may be treated with an aqueous solution of metallic salts or halides or platinum, palladium, vanadium, etc., then, the metal may be fixed to the wick. As the amount to be adhered, 1 ppm–100 ppm (approx.) may be used; however the amount isnot necessarily limited to the range mentioned above, which was limited by economical considerations, and a somewhat better result may be obtained if an amount even greater than the amount suggested above is employed.

A second important factor is to select and improve the primary combustion material. The candle without the introduction of any color former must produce a "colorless" flame in the strict sense of the word. As primary combustion material for forming such a colorless flame, ethyl carbamate and dimethyl oxalate have previously been proposed, but an equally effective material, trioxane should also be noted. The properties common to those materials are that they are the organic compounds with a 35–65% carbon content in their chemical formula and with a melting point of 38–150° C. Waxes such as paraffin, stearin wax, sumac wax and beeswax with more the 65% in carbon content have been used as candle combustion material, but they result in a short supply of oxygen during combustion, and the freed carbon atoms are heated to red resulting in a yellowish flame. It is already known that when the main combustion material burns with a yellow flame, a vivid flame color can not be obtained even if another color former is added. Therefore, in accordance with the teachings of the present invention, the use of a primary combustion material with such a high carbon content should be avoided as much as possible. However, a carbon content lower than 35% is undesirable since it results in a weak burning force and a greatly reduced pyrophoric property. Consequently, the combustion material compounds to be selected having the desirable colorless flame property are those with 35–35%, preferably 40–60%, carbon content.

Furthermore, of the compounds mentioned above, in view of the usual requirement for conventional candles to remain in a solid state at room temperatures, those compounds with a melting point of above 38° C. are preferable but for ease in manufacture, it is preferable that their highest melting point does not exceed 150° C. Needless to say, those emitting any noxious gas while burning, causing irritation when touched by hand or having any poisonous properties must be avoided.

Therefore, as specific examples of practical primary combustion materials, ethyl carbamate, dimethyl oxalate, trioxane, etc. may be named. Of those mentioned above, ethyl carbamate is particularly preferable as the primary combustion material.

It is a well known fact that the combustion flame associated with ethyl carbamate as the primary combustion material is almost colorless, but ethyl carbamate itself is a lower molecular weight urethane, with poor caking properties. Therefore, when used to make a candle of less than 10 mm in diameter, its formability and shape retainability are inferior. In the past, in order to improve on the inferior characteristics, a higher molecular weight fatty acid or a higher molecular alchohol was added, or the formed body was coated with paraffin wax, but when the amount of such added fatty acid or alcohol or the coating material is sufficient to bring about the intended effect, the colorless flame property is defeated by the yellowish orange flame resulting in the combustion of the added or coating material itself. In order to provide good formability and good shape retainability, in accordance with the teachings of the present invention, the amount of higher fatty acids, etc. added is kept to the minimum range necessary for proper release from the mold and a synthetic resin compatible with ethyl carbamate is further added for reinforcement. More specifically, ethyl carbamate may constitute 80–95 parts by weight of the primary combustion material, preferably 85–93 parts by weight and the remaining parts by weight may consist of mold releasing agent, such as a higher fatty acid, and a synthetic resin. When using dimethyl oxalate or trioxane, the compounding ratio is the same as ethyl carbamate.

When so using a higher fatty acid or a higher alcohol, a mixture composed of one or more types selected from those having a melting point of above 30° C. preferably above 38° C. is added in an amount of 0.5–19.8, preferably 2–13 parts by weight. From a practical point of view, stearic acid and stearyl alcohol are especially well suited for such a use. However, as they tend to produce a yellowish orange flame when an increased amount is added, the amount added must be kept within the limits shown above. In order to micronize the crystals formed during the molding of the primary combustion material such as ethyl carbamate, or in order to check the formation of crystals during the molding process, and thereby to improve the material's formability, 0.2–7 parts by weight, preferably 0.5–4 parts by weight, of an inflammable resin that is compatible with ethyl carbamate may be added. A synthetic resin with a good caking property as well as the required compatibility with ethyl carbamate, etc. should be chosen; for example, copolymer resins with organic acids capable of being copolymerized with vinyl acetate may be advantageously utilized such as, by way of a specific example, the copolymer of vinyl acetate with maleic anhydride; the copolymer of vinyl acetate with acrylic acid; and related copolymers with fumaric acid, crotonic acid, itaconic acid, as well as their esters.

A third important factor is that the color forming metals or metallic compounds are made available during the course of combustion. In accordance with the relevant aspects of the present invention, the coloring wick is formed independently of the combustion wick and metallic compounds are prevented from difusing into the main combustion material, but rather are retained in the coloring wick to which, when necessary, is added an oxidation accelerating catalyst in order to produce a satisfactory colored flame. As the color forming compounds so carried by the coloring wick, those which are especially sharp in their wavelength characteristics should be used. Specific examples thereof are, salts of metals such as cobalt, chromium, copper, potassium, sodium, lithium, manganese, antimony, calcium, barium, strontium, cesium, rubidium, tin; lower carboxylates such as acetate, hydroxide, nitrate, carbonate; or higher fatty acid salts, such as stearate. From such metallic salts, in accordance with the desired color, one or several types may be selected for a particular application.

The coloring wick, which as explained above functions as carrier for the color forming metallic compound, may be a flammable fine threadlike material with a diameter of 0.01–1 mm, such as cotton yarn, regenerated natural cellulose or a synthetic fiber. The metallic compound may be bonded to the coloring wick material as follows: the metallic compound and a binder are dissolved or dispersed in an organic solvent; then (1) the wick material is immersed in the solution, or (2) the solution is coated onto the wick, or (3) the solution is bonded to the wick in a molten state; then the surface of the wick thus obtained is coated with a resinoid in order to prevent the diffusion of the metallic compound into the primary combustion material when the coloring wick is embedded therein. The selected resinoid used for the binder and coating should not form either a black smoke or a bright flame when burning and should burn completely. As such synthetic resins, synthetic binding agents which are water soluble, such as polyethylene, ether glycol, may be used. As such resins which may be dissolved in organic solvents, cellulose derivatives, such as nitrocellulose polyethylene or a copolymer thereof, may be employed.

As flammable resins to be used for the above noted coating purposes, those with a low hygloscopicity are preferable, and the aforementioned cellulose derivatives, or polyolefins are effective.

In order to obtain a more effectively colored flame, an oxidation accelerating catalyst is utilized in the above-mentioned coloring wick as well as in the combustion wick. In accordance with the above, the oxidation accelerator which is preferably added to the combustion wick, exercises its catalytic affect at the top of the burning flame, but the coloring wick is below the burning flame at a location that is laterally displaced from the combustion wick; accordingly the effect of the oxidation accelerating catalyst in the combustion wick does extend to the coloring wick. Consequently, though the addition of 1 to 100 ppm of a similar oxidation accelerating catalyst to the coloring wick, the burning is accelerated and the coloring action is further intensified.

The amount of color added to the coloring wick is normally 0.1–5 g/m, preferably 0.2–3 g/m. When the amount of color former added is below 0.1 g/m, the coloring is insufficient, while when it exceeds 5 g/m the combustibility is lowered; either is undesirable. The amount of coating material applied to the coloring wick is 0.01 to 0.5 g/m, preferably 0.02–0.3 g/m.

As mentioned above, the principal teachings of the present invention are as follows. The main combustion material is of a material that burns with a colorless flame such as ethyl carbamate, to which a compatible synthetic resin may be added; a separate coloring wick is processed to carry a chromogenic (color forming) metallic compound as well as an oxidation accelerating catalyst and coated with resin on its surface; a combustion wick also treated with an oxidation accelerating catalyst; and the separate coloring and combustion wicks are laid out near the center of the combustion material adjacent to each other. Only after satisfying these factors, can a candle capable of forming vividly colored flames be obtained.

The manner in which the coloring wick and combustion wick are separated distributed within the body of the candle is the fourth significant factor. In accordance with the teachings of the present invention, the coloring wick and the combustion wick are embedded in the main combustion material either parallel at closely spaced locations to each other or else with the coloring wick wound once to several times around the combustion wick. In the later case, it is desirable to coil the coloring wick around the combustion wick in a direction reversed to the twisting direction of the combustion wick, as an appropriate spacing can be maintained in this manner. Finally, it is possible that several coloring wicks of the same type or of different types may be used with a single combustion wick.

Figure 2:
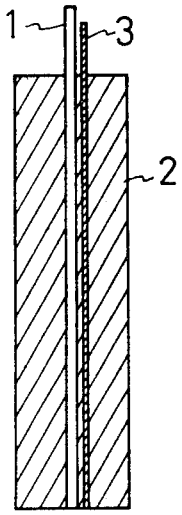
FIG. 2 is a cross-section along the lines A—A of the candle of FIG. 1.
Figure 3:
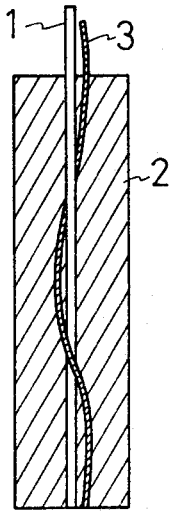
FIGS. 3 and 4 are cross-sectional views showing examples of alternative embodiments of a colored flame candle in accordance with the teachings of the present invention.
Figure 4:
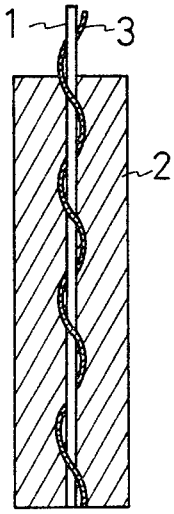

As shown in FIG. 1, the candle body is composed of a combustion wick 1 and primary combustion material 2 and at a location adjacent to the combustion wick 1 a separate coloring wick 3 is also provided. In accordance with alternative preferred embodiments relating to the manner that the coloring wick 3 may be located nearby the combustion wick 1, the coloring wick 3 may be along side of the combustion wick 1, as shown in FIG. 2, or loosely would around it once, as shown in FIG. 3, or coiled around it an appropriate number of times as shown in FIG. 4.

Figure 5:
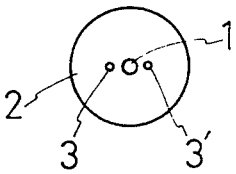
FIG. 5 is a plan view showing another exemplary embodiment having two coloring wicks.
Figure 6:
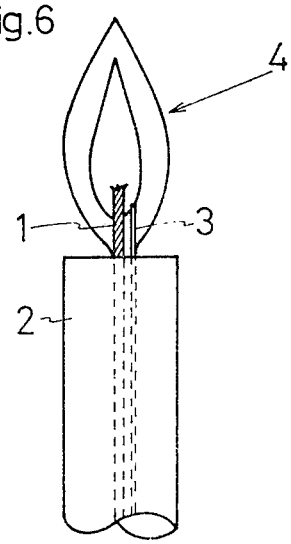
FIG. 6 is a side view of a colored flame candle showing the relationship between the combustion wick and the coloring wick during the burning of the candle.

As shown in FIG. 5 two coloring wicks 3 and 3' may be embedded in the primary combustion material 2, by setting the locations of the coloring wicks 3 and 3' on both sides of the combustion wick 1, in parallel to each other. If a different type of metallic compound is contained in each of the coloring wicks 3 and 3', for forming different colored flames on each side, an especially interested colored flame candle may be obtained. It is also feasible to increase the number of coloring wicks in such a multi-colored arrangement to three to five provided the whole outer circumference of the combustion wick 1 is not so covered. The matter of distributing the coloring wicks 3 around the combustion wick 1 can be varied suitably according to the diameter of the primary combustion material 2 such as to allow the combustion wick and the coloring wick to be in partial contact with each other or to keep them slightly separated in location. However, it is particularly desirable that, as shown in FIG. 6, that the top end of the coloring wick 3 enter the flame 4 together with the combustion wick 1 and that the coloring wick 3 always burn a little more quickly than the combustion wick 1 so that the top end of the coloring wick 3 is located at the lower part of the flame.

Actual specific examples of candles constructed according with the teachings of the present invention will now be discussed in the following paragraphs, but the invention should not be construed as being limited by these specific examples.

EXAMPLE 1

Twelve grams of lithium chloride and 0.1 g of polyethylene ether glycol were dissolved in 87 g of water to obtain a color former solution. In a separate procedure, 0.1 g of platinic chloride was dissolved in 200 cc of water and after adding 5 g of alumina micropowder and stirring the mixture, 0.2 g of hydrazine and 0.1 g caustic soda were added. Then after stirring the mixture again, 2 l of water were added and the resulting mixture was left to stand overnight. The resulting precipitated alumina micropowder was separated from the water to obtain a platinum catalytic powder.

The coloring wick was prepared as follows. A twisted yarn made by strongly twisting 3 strands of No. 20 Count cotton threads was dipped in the above color former solution, then dried at 120° C. This dipping and drying procedure was repeated three times. In this way, about 2 g of color former solution was caused to be bonded to the twisted yarn. The twisted yarn with adhering color former was then immersed in a treatment solution prepared by dissolving the copolymer of vinyl acetate and ethylene (25:75 molecular ratio) in triclene and by making the necessary adjustments to bring the solution concentration to 7%. The twisted yarn was then taken out of the treatment solution and air dried.

The combustion wick was prepared as follows: Starting with a candle wick made from a round cord resulting from the knitting with No. 8 needles of three strands of No. 20 Count cotton thread, the candle wick was dipped in a solution formed of 1 g of the above-mentioned platinum catalytic powder dispersed in 5 l of water and then dried.

Then the combustion wick was held at the center of a 600 mm long octagonal (42 mm on each side) mold of silicon rubber and two coloring wicks were held vertically on both sides of the combustion wick at a distance of 2–3 mm from the combustion wick. Thereafter, ethyl carbamate (urethane) liquified by heating to 65°–70° C. was poured into the mold and allowed to cool to thereby produce an octagonal candle.

The candle thus obtained had the requisite shape retainability and strength, as well as a good appearance as a commercial product. When lit, it burned with a vivid dark red flame.

EXAMPLE 2

Twelve grams of lithium chloride and 0.1 g of polyethylene ether glycol were dissolved in 87 g of water to form a lithium chloride solution. In a separate procedure, 0.1 g of platinic chloride was dissolved in 200 cc of water, and the mixture was stirred after adding 5 g of alumina micropowder. Then, 0.2 g of hydrazine and 0.1 g of caustic soda were added and the mixture was stirred again. Thereafter, 2 l of water was added and the resultant mixture was left to stand over night. The precipated alumina micropowder was separated from the water, and 0.1 g of platinum catalytic powder thus obtained was mixed in the lithium chloride solution to prepare a color former solution. Into the color former solution, No. 20 Count cotton yarn was dipped and dried at 120° C. This dipping and drying procedure was repeated three times and about 2 g of color former was caused to be adhered to the cotton yarn. The cotton yarn was then soaked in a treatment solution prepared by dissolving the copolymer of vinyl acetate with ethylene (25:75 molecular ratio) in triclene and the solution was then adjusted as necessary to make its concentration 7%. The yarn was then taken out of the solution, and air dried. A colring was thus obtained.

The combustion wick was prepared by dipping a candle wick fabricated by twisting together 30 strands of No. 20 Count cotton yarn in a solution containing 1 g of the above-described platinum catalytic powder dispersed in 5 l of water and then drying the wick. The above-described coloring wick was coiled around the combustion wick in a direction opposite to the twisting direction of the combustion wick, with a pitch of one rotation to every 25 mm of distance. The composite wick thus obtained was placed at the center of a 70 mm long gypsum mold with a diameter of 8 mm. Then, a primary combustion material composed of ethyl carbamate (94%), stearic acid (5%), and a copolymer of vinyl acetate with maleic anhydride in a molecular ratio of 1:1 (1%) was melted by heating it to 75° C. and poured into the gypsum mold and allowed to solidify. After 20 minutes, the candle was removed from the mold and commercial product similar in section to that shown in FIG. 4 as obtained. The candle thus obtained was slender and only 8 mm in diameter, but it had sufficient shape retainability and the strength required for proper functioning as a candle. Also, it had a commercially desirable appearance and burned with a vividly colored deep red flame when lit.

EXAMPLE 3

A solution containing 35 g of cupric chlordie as color former, 1 g of copolymer of vinyl acetate with ethylene (20:80 molecular ratio) as a binder, and 0.005 g of platinic chloride as oxidation accelerating catalyst, was dispersed and dissolved in 64 g of triclene. Using the same procedure as described above in Example 2, the cotton yarn was dipped in the solution and then, in addition, the yarn was dipped in an ethyl acetate solution of 5% nitrocellulose, to produce a coloring wick with 0.2 g/m of color former adhered to it, and a resin coating on its surface.

A combustion wick was prepared by impregnating twisted yarn obtained by twisting 18 strands of No. 30 Count cotton yarn by dipping the yarn once into a solution of ethyl carbamate heated to 50° C. The above described combustion wick and coloring wick were inserted and fixed at the center of a 100 mm long cylindrical mold with a diameter of 8 mm, the two wicks being in parallel to each other in spatial relationship, as shown in FIGS. 1 and 2. Then, the primary combustion material, a mixture of ethyl carbamate (95%), stearic acid (4%), and a polymer of vinyl acetate with methyl acrylate (30:70 molecular ratio), was heated to 57° C. and poured into said cylindrical mold. After solidifying at room temperature, the contents were released from the mold and a commercially acceptable product was obtained.

A similar result could have been obtained by using dimethyl oxalate or trioxane, in plase of the ethyl carbamate.

When the coloring flame candle thus obtained was lit it burned with a desirable vivid bluish-green flame. Furthermore, even when dropped onto a wood board from a height of 2.5 m, it did not break, demonstrating its very satisfactory shape retainability and strength.

It should be apparent to those skilled in the art that the above described embodiments are merely illustrative of but a few of the many specific embodiments which represent the applications and the principals of the present inventions. Numerous and various other arrangements could be readily devised by those skilled in the art without departing from the spirit and scope of the present invention.

We claim:

1. A colored flame candle comprising a primary combustable material that burns with the colorless flame, a combustion wick and a coloring wick wherein:

a combustion wick from plaited or twisted cotton yarn to which an oxidation accelerating catalyst which is selected from the group consisting of platinum, palladium and vanadium and mixtures thereof is added; and a coloring wick separated from but adjacent to said combustion wick, said coloring wick comprising a flammable thread-like material, a metallic color former compound, an oxidation accelerating catalyst which is selected from the group consisting of platinum, palladium and vanadium and mixtures thereof and a combustible resin coating.

2. A colored flame candle as set forth in claim 1, wherein said oxidation accelerating catalyst is platinic chloride.

3. A colored flame candle as set forth in claim 1, wherein said oxidation accelerating catalyst is pallidium chloride.

4. A colored flame candle as set forth in claim 1, wherein said oxidation accelerating catalyst is vanadium chloride.

5. A colored flame candle as set forth in claim 1, wherein the amount of said oxidation accelerating catalyst is 1:100 ppm by weight of said combustion wick.

6. A colored flame candle as set forth in claim 1, wherein said combustible resin is selected from the group consisting of polyethylene glycols, cellulose derivatives, polyolefins and mixtures thereof.

7. A colored flame candle as set forth in claim 1, wherein the spatial layout of said coloring wick in relation to said combustion wick is a parallel, side by side, arrangement.

8. A colored flame candle as set forth in claim 1, wherein a plurality of said coloring wicks are arranged in parallel to said combustion wick.

9. A colored flame candle, as set forth in claim 1, wherein said coloring wick is coiled around said combustion wick.

* * * * *